US006860704B2

(12) United States Patent
Buoncuore

(10) Patent No.: US 6,860,704 B2
(45) Date of Patent: Mar. 1, 2005

(54) RAIL CAR LID LIFTER

(76) Inventor: Steven Buoncuore, 51 N. DuPont Rd., Carneys Point, NJ (US) 08069

( * ) Notice: Subject to any disclaimer, the term of this patent is extended or adjusted under 35 U.S.C. 154(b) by 196 days.

(21) Appl. No.: 09/931,998

(22) Filed: Aug. 17, 2001

(65) Prior Publication Data

US 2002/0021957 A1 Feb. 21, 2002

Related U.S. Application Data

(60) Provisional application No. 60/226,512, filed on Aug. 21, 2000.

(51) Int. Cl.[7] ..... B66F 9/12

(52) U.S. Cl. ..... 414/607

(58) Field of Search ..... 414/684.3, 607, 414/608, 10; 105/377.01, 377.08, 377.11; 187/222, 237; 296/100

(56) References Cited

U.S. PATENT DOCUMENTS

| | | | | | |
|---|---|---|---|---|---|
| 2,985,118 | A | | 5/1961 | Maharick et al. | |
| 3,759,399 | A | * | 9/1973 | Glass et al. | 414/607 X |
| 3,994,240 | A | * | 11/1976 | Berg et al. | 105/377 |
| 4,824,317 | A | * | 4/1989 | Schroder | 414/607 |
| 4,854,809 | A | * | 8/1989 | Rhodes | 414/685 |
| 5,054,402 | A | | 10/1991 | Brassell | |
| 5,456,188 | A | | 10/1995 | Lowing | |
| 5,486,083 | A | * | 1/1996 | Thompson | 414/607 |

FOREIGN PATENT DOCUMENTS

| | | | | |
|---|---|---|---|---|
| CA | 1055989 | * | 6/1979 | 414/608 |
| JP | 406016398 A | * | 1/1994 | 414/607 |

* cited by examiner

*Primary Examiner*—James W. Keenan
(74) *Attorney, Agent, or Firm*—Edward J. Kaliski

(57) ABSTRACT

A self-standing structure supporting a fixed boom is built on a palette-like base that is picked up and moved by a fork truck. Railroad car lids with a variety of handles can be engaged by the boom which has fittings suited to that purpose, lifted and removed by the fork truck operator so that the contents of the car such as coils of metal can be lifted out by a crane or the like.

9 Claims, 6 Drawing Sheets

RAIL CAR LID LIFTER

REFERENCE TO RELATED APPLICATIONS

This application claims benefit of provisional application No. 60/226,512 filed Aug. 21, 2000.

FIELD OF THE INVENTION

This invention relates to the field of material handling and more particularly to apparatus to lift, remove, store and replace rail car lids.

BACKGROUND OF THE INVENTION

Railroad cars such as gondolas that carry various size metal coils are covered with one or two metal lids. The top of some cars reach five and half feet from the railroad track. The top of the load lifting attachment (handle) on the top of the lids may be fourteen to fifteen feet above ground. In the normal operation of loading rails cars with large metal coils which can weigh fifteen to twenty-two tons, a crane is used, usually with a four legged bridle, to remove the lids from the rail cars. These lids are then placed far enough from the crane so coils can be delivered within reach of the crane to load the rail car. The crane operator can not do this unassisted. To attach the bridle, a man must climb onto the lid, which is inherently dangerous since these lids do not provide catwalks. This rigging is time consuming and labor intensive as well.

It is, therefore, an object of this invention to provide apparatus that will safely and economically permit removal of the lids without rigging a crane for this purpose. Furthermore, rail yards in which this type of work is carried out have many fork lift trucks which are adapted to transport, lift and lower loads, ordinarily on skids or pallets, in the course of loading and unloading such heavy materiel as metal coils.

It is a further object of this invention to provide an accessory to such a fork lift truck that will permit the operator to engage, lift, transport and lower to temporary storage a rail car lid without the intervention of anyone other than the fork lift operator or use of any other piece of material handling apparatus.

A still further object of the invention is to provide an accessory that will not require any modification of the fork lift truck such as removal or replacement of the forks in order to engage in rail car lid lifting.

BRIEF DESCRIPTION OF THE INVENTION

The invention which solves the objects stated above is an adjunct to an industrial fork lift truck comprising a boom adapted to engage all common forms of railcar lid handles and of adequate strength and length mounted on a frame of adequate height that has a palette-like base adapted for handling by a fork lift truck. It comprises a base configured as a palette adapted for fork truck handling, a frame mounted thereto, and a boom mounted to the frame at one end of the boom and having generally at the other end at least one fitting for engaging a lid handle wherein the assembly of said boom, frame and base freely stands on the base when not in use thereby providing convenient means for removing storing and replacing rail car lids and for storing the lifter itself while the fork truck is otherwise engaged.

In another embodiment for use with a ram truck that handles coils of sheet metal, the palette-like base carries a collar extending through the base through which the ram of the truck can be passed. Locking means are provided. This preferred embodiment is configured so that it can be handled by a fork truck as well as a ram truck.

DETAILED DESCRIPTION OF THE INVENTION

Figure 1:
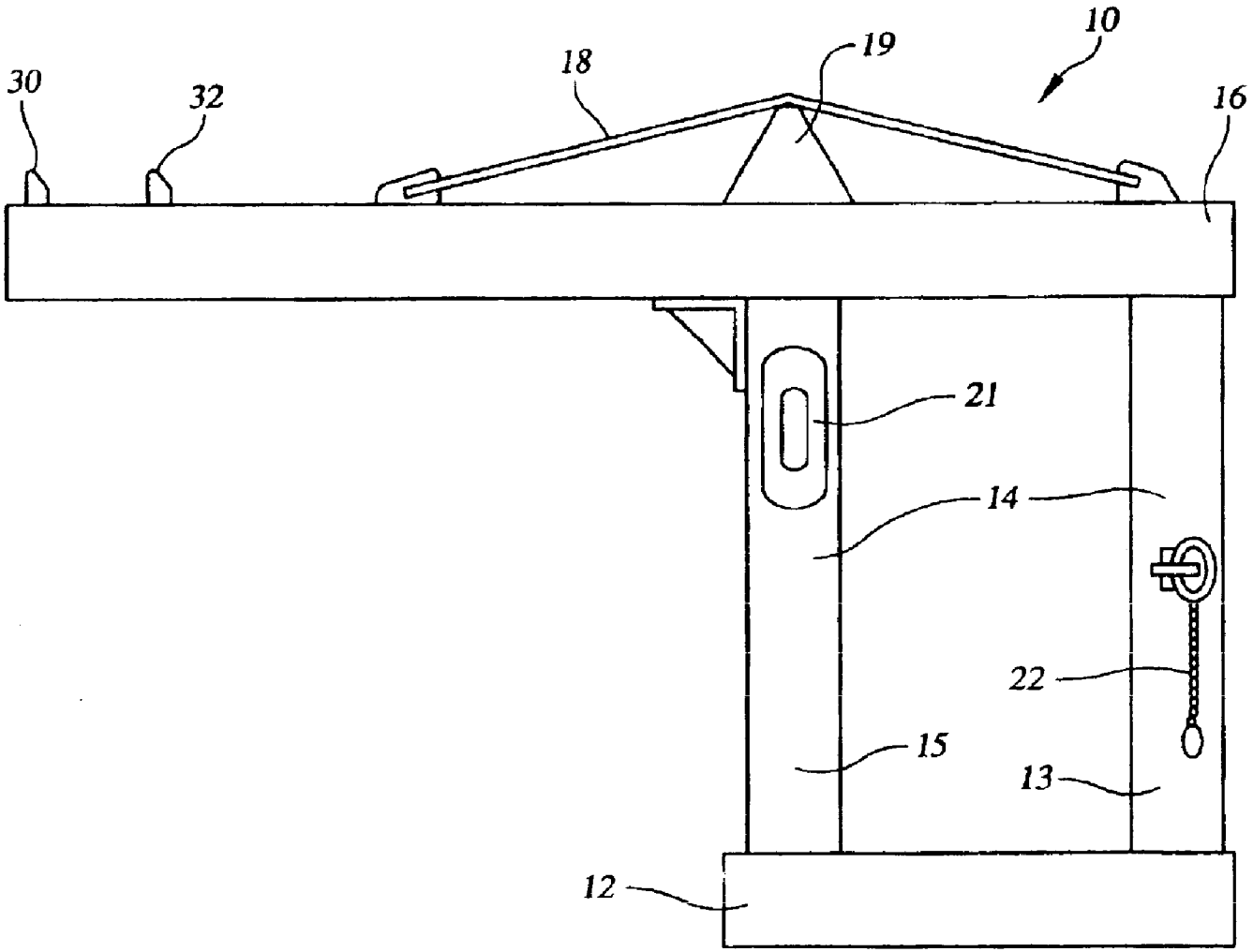
FIG. 1 is a side elevational view of the railcar lid remover of the invention.

The railcar lid remover or lifter 10 of the invention, as seen in FIG. 1, is a self-standing unit which can be stored convenient to an area where gondola cars and the like are unloaded by cranes. The structure stands on base 12 which is configured as a palette for handling by a standard industrial fork truck commonly used in loading yards. Base 12 is fabricated from members, preferably steel, of sufficient strength and thickness to withstand the loads encountered in working with the various rail car lidsf metal which may weigh as much as 1 ton. A welded structure is preferred for the base and for fabricating and joining all elements of the structure with the exception of certain fittings which are removably fastened to a boom 16.

Mounted on base 12 is frame 14, also of sufficient strength to withstand the forces of compression, bending and twisting encountered in service. It is high enough so that boom 16 which is mounted to frame 14 can be lifted by a fork truck 20 within the limits of its vertical lift distance to a level clearing the top of a lidded railcar standing on the tracks. Boom 16 is long enough to permit reaching the centerline of a railcar 17 when the fork truck has approached relatively close to the side of the car but not so long that an overturning moment is created in use or when the device is standing alone in storage. Stay 18 and standoff 19 may be provided to minimize boom bending when a lid is picked up. Safety strap 22 is provided so that the operator of the fork can insure that the lid remover remains in place on the forks when in use especially during transport without a load. This is a strong, flexible strap, cable or chain, attached to the frame at one end and of sufficient length to wrap around a part of the fork truck and, at the other end, terminated in a loop, or some equivalent for fastening the truck and frame together. It readily is released when the operator drops the lid lifter 10 for storage and returns the fork truck 20 to other activities.

Figure 2:
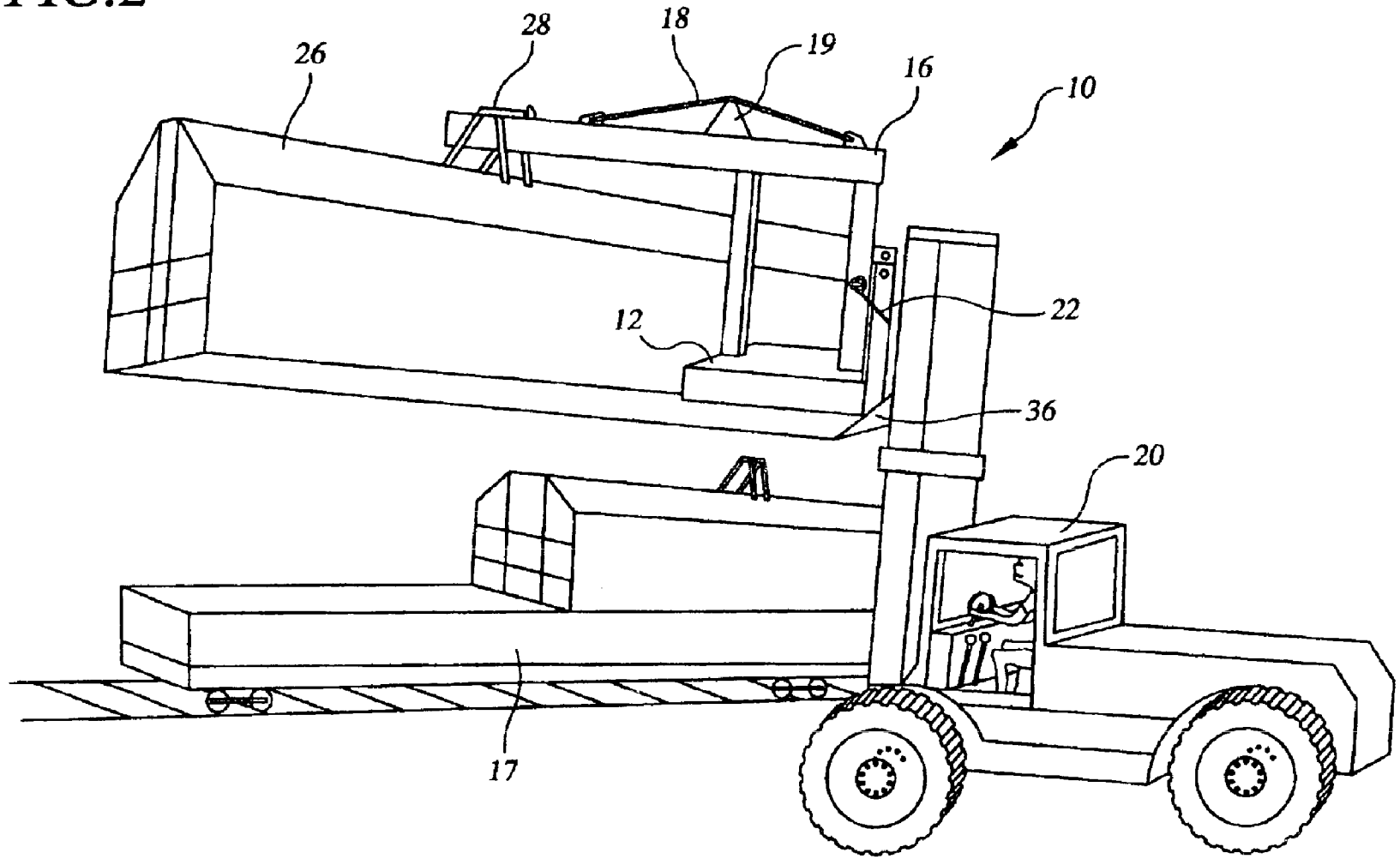
FIG. 2 is a perspective view of the invention in use with a fork truck (partially shown) with the boom of the invention engaged with the handle of a railcar lid.

FIG. 2 shows a typical lid removal activity (the replacement procedure essentially is the reverse). Rail car 17, here a gondola, is covered by one or more lids 26. These have centrally located handles 28. Unfortunately, the railroad industry has not settled on a single standard design for a rail car lid handle. Four differing units are common and these are shown in FIGS. 5*a*, 5*b*, 5*c*, and 5*d*. For convenience boom 16 carries fittings 30 and 32 which are configured so that any one of the four types of handles can be engaged. Fitting 30 is a saddle on the upper surface of boom 16. This is suited to the handle of FIG. 5*d*. Limit stop 32 is spaced a short distance away on the top surface of boom 16 between fitting 30 and the end of the boom above frame 14. This prevents a lid from sliding along the boom too far toward the fork truck if the operator errs. Fitting 34 is a pair of hooks on the lower surface of boom 16 useful for any variety of handle 28 which does not allow clearance for the boom between the top of the lid and the bottom of the handle or between upright member thereof. If ever other handle designs appear, it would be simple to provide suitable fittings.

Lifter 10 is shown in FIG. 2 with base 12 engaged on forks 36 of the fork truck. These have been lifted high enough for boom 16 to be inserted into handle 28 and then lifted so that fitting 30 engages and then lifts handle 28 and lid 26.

Figure 5A:
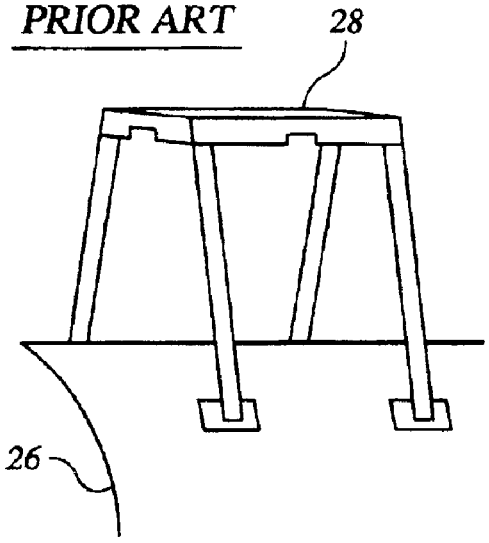
FIG.5A PRIOR ART
FIGS. 5*a*, 5*b*, 5*c*, 5*d* are partial perspective views of typical car lid handles.
Figure 5B:
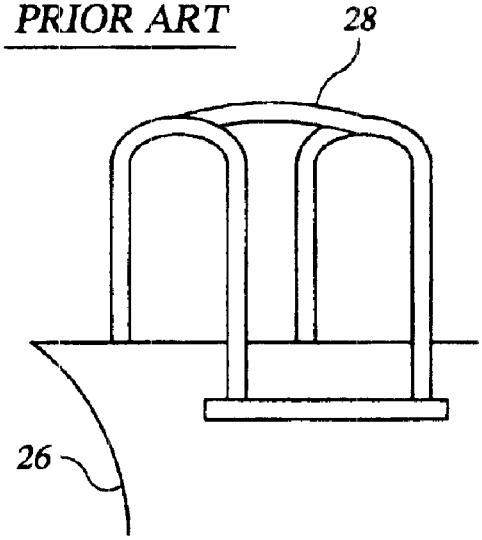
FIG.5B PRIOR ART
Figure 5C:
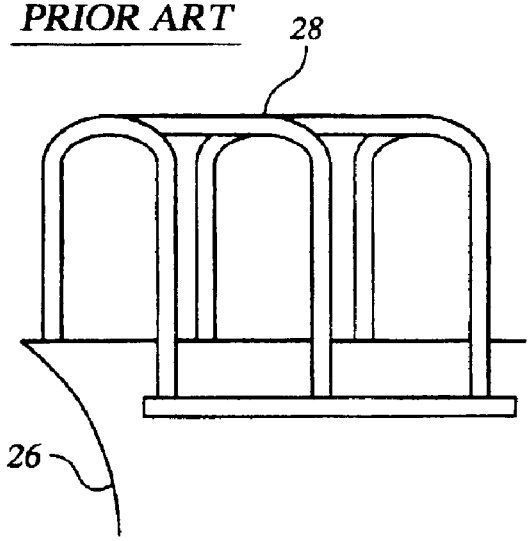
FIG.5C PRIOR ART
Figure 5D:
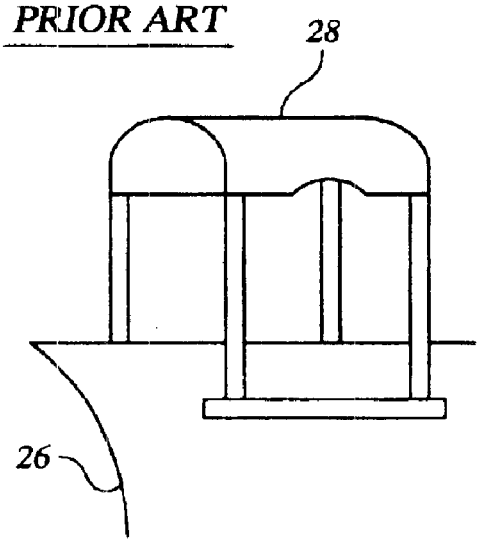
FIG.5D PRIOR ART

For lids having handles of the type shown in FIG. 5*d*, it is preferred to modify saddle fitting 30 by replacing it with plug fitting 23. Suitable fasteners, not shown, hold the plug fitting 23 in place. An advantage of this arrangement in use is that plug 23 fits into the inside of the top of the handle and prevents it from swiveling. An elastomeric, or other cushioning material, pad 25 may be secured to the upper surface of plug fitting 23.

A preferred lid remover has the following dimensions:

Base 12 is 9 inches high by 5 foot 8 inches on a side and fabricated from $\frac{5}{8}^{th}$ inch steel plate. Two opposing sides are fabricated 8 inch by 6 and ½ inch by ½ inch I-beams with one side cut away. The remaining flange is welded in place on the underside of the base with the flange facing in. Two facing plates, with 7 inch high by 9 inch cutouts ("pockets") for entry of the forks, are welded one inch from the end of the base to the underside and each is braced by two one inch thick triangular steel gussets.

Figure 3:
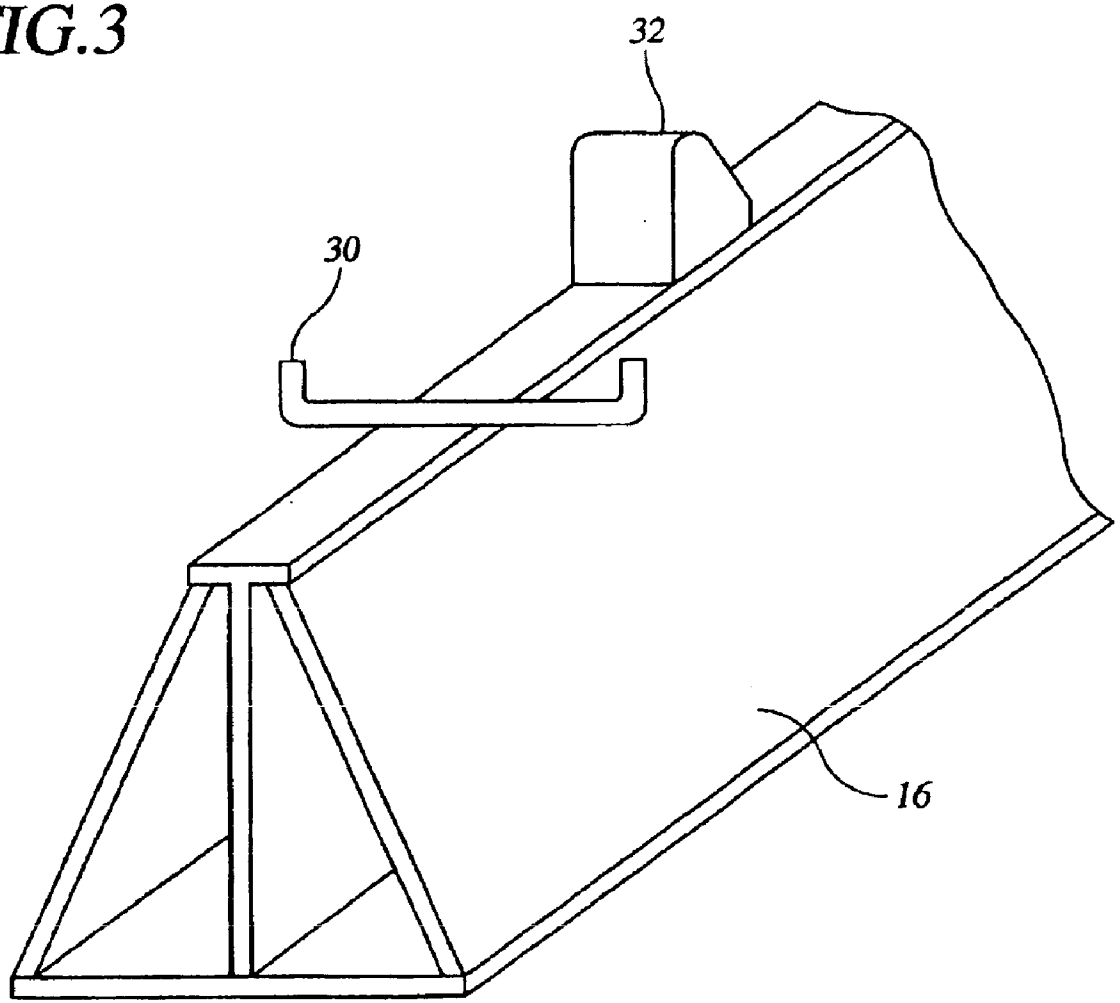
FIG. 3 is a partial perspective view of a preferred boom without the end cap.
Figure 4:
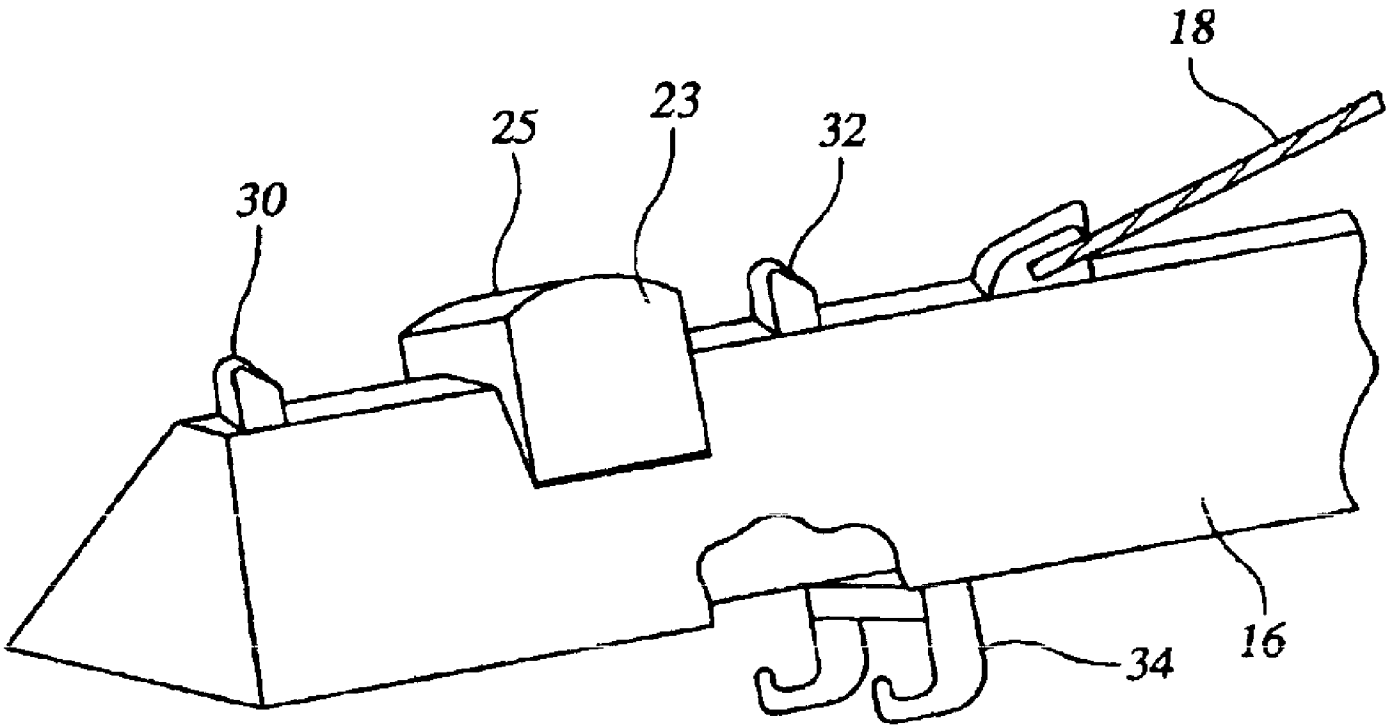
FIG. 4 is a partial perspective view of the preferred boom showing an alternate lifting fitting the boom having a broken-away section to show lifting hooks.

Frame 14 comprises two 8 inch by 8 inch by ⅜ inch box tubes 15 and 13 that are 7 feet long and welded to base 12 slightly in from opposite ends along the centerline between the cutouts. Welded on top of the two box tubes, is boom 16 which is fabricated from a modified 8 inch by 6 and ½ inch by ½ inch I-beam with ½ inch plates for the sides as shown in FIG. 3. A cap is welded on each end of boom 16. Fish plates 21 reinforce the welded joints. Saddle 30 is removably bolted on top of boom 16 about one foot from the end and stop 32 is spaced about 1 foot 3 inches farther in. An elastomeric pad 25 may be cemented on the top surface of plug 23.

In use, car 17 is spotted. An operator drives fork truck 20 to where lid lifter 10 stands in storage, adjusts the height of the forks 36, aims and drives the forks into engagement in the base 12 which is then lifted slightly for transport after safety strap 22 is fastened to the fork truck 20. The operator approaches the side of rail car 17 and aims boom 16 into handle 28 by lifting and/or tilting the lift mechanism of the truck and driving the truck forward. A further slight lift engages saddle fitting 30' with handle 28. Additional lifting raises lid 26 away from car 17 and the fork truck 20 with its load can be backed out of the way. Car 17 can then be emptied as is customary using a crane while lid 26 is held with the fork truck or stored on the ground. When the car 17 is empty, lid 26 then can be returned and lowered into position there. The fork truck operator then can disengage boom 16 from lid 26 and back away. At will, lid lifter 10 can be stored by transporting it to a selected spot, lowering it to the ground and pulling out the fork or ram.

Figure 6:
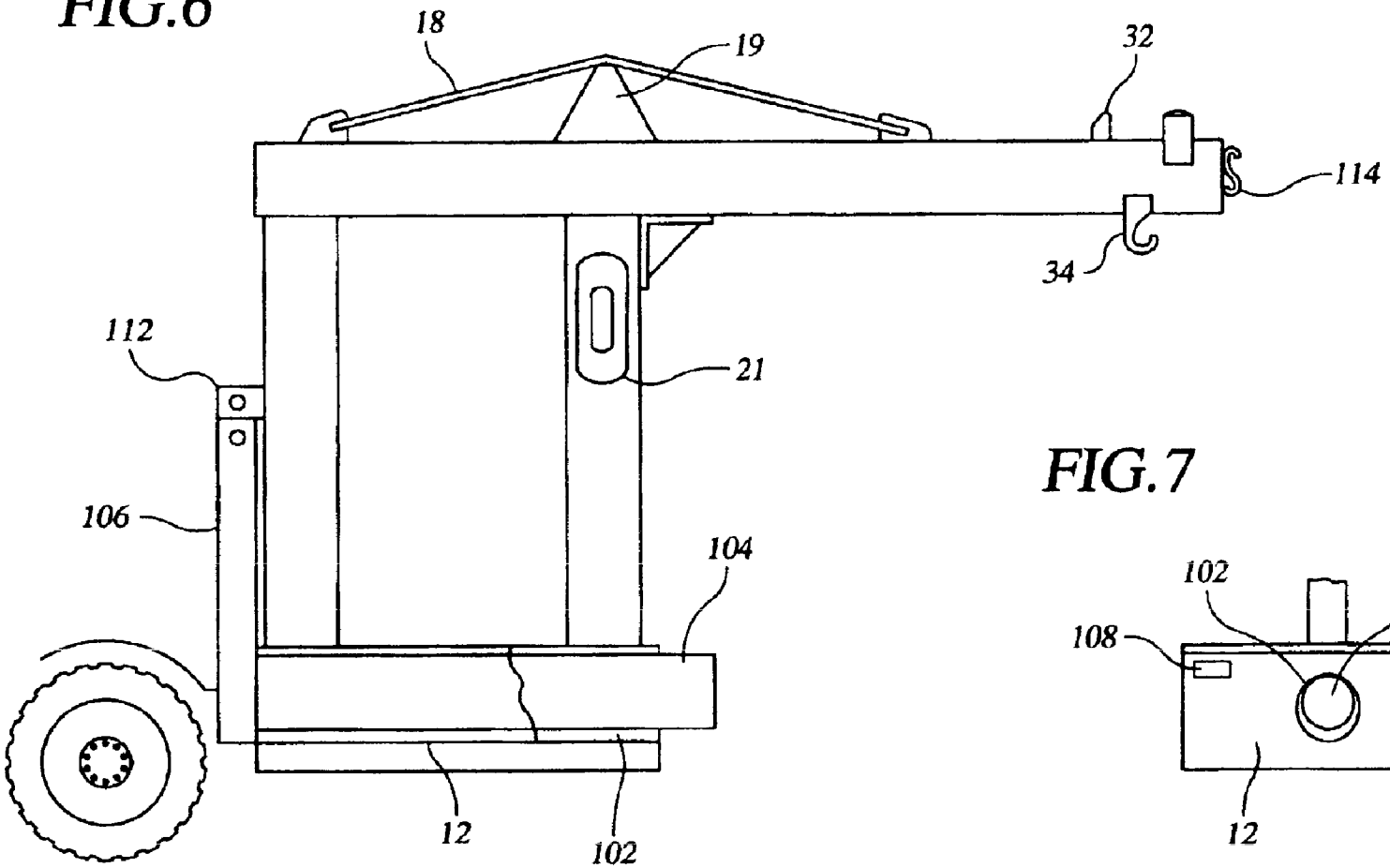
FIG. 6 is a side elevational view of a further embodiment adapted for use by a ram truck.
Figure 7:
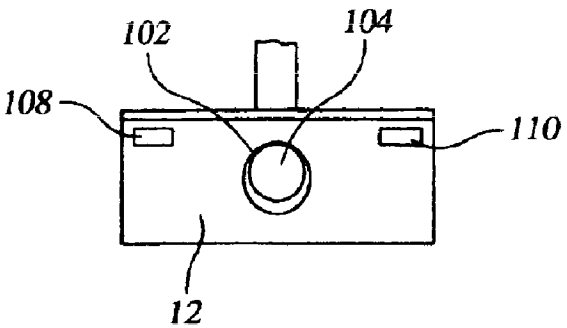
FIG. 7 is a partial end view of the embodiment of FIG. 6.

In yards handling coils of metal, it is common to use ram trucks. These are fork truck with the fork assembly unfastened and replaced by a moldboard 106 onto which a length of heavy pipe has been mounted to act as a "ram" 104. The operator simply runs this ram 104 into the core of a coil to lift and transport it. FIGS. 6 and 7 show an alternate embodiment of the rail car lid lifter 10 in which the base 12 is considerably enlarged in height to accommodate a through collar 102, welded in place under the top member of base 12. This collar is sized so that a ram 104 is an easy fit inside as seen in FIG. 7. Pockets 108 and 110 are provided so that lifter 10 can be used with a regular fork truck as well. The advantage of using the ram-adapted configuration is that the same truck unit can handle lids and coils. For safety, moldboard 106 and lifter 10 have attached matching ears 112 with holes, one on one member and two on the other, that engage aligning the holes so that a pin, not shown, can lock the two units together. FIG. 6 also shows an optional accessory which is shackle 114 to which a safety hook or the like can be attached.

Details of preferred component-structures are shown in the figures. These are designer choices and other configurations and materials of construction could be used to perform the illustrated and described functions within the strength and geometric limitations imposed by the intended service.

What is claimed is:

1. As an accessory to a fork lift truck, a rail car lid lifter for lifting and removing and replacing the removable lid of a rail car, said lid fitted with a lid handle enclosing an open-sided space, by engaging the lifter with the truck and using the lifting and moving capabilities of the truck, comprising: a base configured as a pallet adapted for fork truck handling, said base having a lower surface for ground contact and an upper surface for mounting; said fork truck accessory comprising apertures extending through said base for the introduction in use of the forks of said fork truck; a frame mounted to said base, said frame comprising a structure interconnecting said base and a boom, said boom comprising an elongated structure extending from a proximal end mounted to the frame and having generally at the distal end at least one fitting for engaging the lid handle and said boom having upper and lower suraces generally parallel to the lower surface of said base and said surfaces spaced at said distal end to fit within said open sided space of said lid handle, wherein the assembly of said boom, frame and base freely stands upon the ground on the lower surface of said base when not in use wherein there is a limit stop comprising a protuberance on said upper surface between the distal end of the boom and the frame whereby an engaged lid handle cannot inadvertently slide toward the frame beyond said stop.

2. The lid lifter of claim 1, wherein there is a safety strap comprising a strong, flexible means, flexibly attached to the frame at one end, and of sufficient length to wrap around a part of the fork truck and, at the other end, terminated in fastening means whereby an operator may removably secure the frame to said fork truck during fork truck handling.

3. The lid lifter of claim 1 wherein the at least one fitting is a plug and the plug has an elastomeric covering.

4. The lid lifter of claim 1 wherein the frame comprises at least one column.

5. The lid lifter of claim 1 wherein the end of the boom distal from the frame has a lifting hook fitting on the lower surface whereby a lid handle can be engaged by said hook fitting during fork truck handling.

6. The rail car lid lifter of claim 1 adapted for ram truck handling, said ram truck comprising a fork truck wherein the fork assembly has been unfastened and replaced by a moldboard onto which a length of heavy pipe has been mounted to act as a ram for engaging and moving coils, said lifter further comprising: a collar extending through the base for reception of said ram.

7. The lid lifter of claim 6 wherein the frame has at least one ear attached thereto with a hole therein that matches at least one ear with a hole.

8. The lid lifter of claim 1 wherein the at least one fitting is a saddle on the upper surface of the boom.

9. The lid lifter of claim 1 wherein the at least one fitting is a plug on the upper surface of the boom.

* * * * *